US007014675B2

(12) United States Patent
Nakai et al.

(10) Patent No.: US 7,014,675 B2
(45) Date of Patent: Mar. 21, 2006

(54) ELECTRIC VACUUM CLEANER EQUIPPED WITH A DUST COLLECTION UNIT

(75) Inventors: Koichi Nakai, Hyogo (JP); Atsuo Hamada, Hyogo (JP); Kazumasa Kamatani, Hyogo (JP); Kazuyoshi Yoshimi, Hyogo (JP); Akihiro Yoneyama, Hyogo (JP)

(73) Assignee: Sanyo Electric Co., Ltd., Osaka (JP)

( * ) Notice: Subject to any disclaimer, the term of this patent is extended or adjusted under 35 U.S.C. 154(b) by 478 days.

(21) Appl. No.: 10/321,430

(22) Filed: Dec. 18, 2002

(65) Prior Publication Data

US 2003/0121121 A1 Jul. 3, 2003

(30) Foreign Application Priority Data

Dec. 28, 2001 (JP) ..... 2001-399354

(51) Int. Cl.
*B01D 35/30* (2006.01)

(52) U.S. Cl. ..... 55/429; 55/433; 15/350; 15/353

(58) Field of Classification Search ..... 55/429, 55/432, 433; 15/350, 352, 353
See application file for complete search history.

(56) References Cited

U.S. PATENT DOCUMENTS 6,502,278 B1 * 1/2003 Oh et al. ..... 15/353
2004/0112022 A1 * 6/2004 Vujik ..... 55/429

FOREIGN PATENT DOCUMENTS

EP 1023 864 A2 8/2000
EP 1 370 172 B1 10/2004

OTHER PUBLICATIONS

Examination Report Under Section 18(3) from U.K. Patent Office, dated Dec. 17, 2004.

* cited by examiner

*Primary Examiner*—Robert A. Hopkins
(74) *Attorney, Agent, or Firm*—Westerman, Hattori, Daniels & Adrian, LLP

(57) ABSTRACT

An electric vacuum cleaner is equipped with a dust collection unit (20) that can be detachably installed in the air passage en route from a suction unit to an electric fan of the cleaner. The dust collection unit (20) comprises a dust collecting case (21) for accumulating dust sucked in, a lid member (32) that can be opened to discharge the accumulated dust; and a lock mechanism (clamp lever) (33) for locking the lid member 32 tightly closed. The electric vacuum cleaner is further provided with a lid opening mechanism (lid opening stick (35) for forcibly opening the lid member (32) in cooperation with the lock mechanism locking the lid member. Even when the sealing pressure of the packing is high or when the accumulated dust does not weigh on the lid member because the dust is compacted on the inner wall of the dust collecting case, the lid member can be opened without difficulty to discharge the dust, without opening it by hand. Thus, the user can avoid handling unsanitary dust.

5 Claims, 19 Drawing Sheets

(SECTION ON A – A)

ELECTRIC VACUUM CLEANER EQUIPPED WITH A DUST COLLECTION UNIT

FIELD OF THE INVENTION

The invention relates to an electric vacuum cleaner equipped with a dust collection unit, installed in a suction passage en route from a suction unit to an electric fan, the dust collection unit having a dust collecting case that can be opened by opening a lid member thereof to discharge the accumulated dust, and a lock mechanism for tightly locking the closed lid member.

BACKGROUND OF THE INVENTION

Some of conventional electric vacuum cleaners, especially upright (or vertical type) vacuum cleaners are equipped with a dust collecting case, detachably installed in a suction passage, for accumulating dust in a cylindrical filter fitted in the dust collecting case. The accumulated dust is removed by opening a lid of the dust collection unit. Such dust collection unit is economical as compared with a disposable paper bag in that the unit can be used semipermanently.

An example of this type of vacuum cleaners is disclosed in Japanese Patent Application Early Publication 2000-342492 (A47L 9/10).

In this cleaner, the lid of a dust collecting case is configured to be opened by the weight of the dust itself accumulated in the dust collecting case when a clamp hook locking the lid is unlocked.

This type of dust collection unit is provided with a packing for sealing the periphery of the lid to prevent leakage of dust. In order to enhance the sealing, the sealing pressure of the packing must be raised. However, if the sealing pressure is raised, movement of the lid will become heavy. Furthermore, as the amount of dust accumulated in the dust collecting case increases, the dust will be compacted on the inner wall of the dust collecting case, thereby failing to weigh on the lid. For these reasons, the lid will not always open by itself if the lid is unlocked by releasing the clamp hook, and, in that event, it must be forcibly opened by hand. This work is tedious and unsanitary.

SUMMARY OF THE INVENTION

In view of the problem pertinent to the prior art as mentioned above, the invention is directed to an improved dust collection unit.

It is an object of the invention to provide an electric vacuum cleaner equipped with a dust collection unit in which the lid of the dust collecting case can be opened without difficulty without any manual operation if dust is compacted on the inner wall of the case under a high sealing pressure and/or if the weight of the dust does not facilitate opening of the lid, the invention thereby allowing the user to avoid unsanitary job.

In accordance with an object of the invention above, there is provided an electric vacuum cleaner equipped with a dust collection unit detachably installed in the air suction passage of the cleaner en route from a suction unit to an electric fan thereof, said dust collection unit comprising:

a dust collecting case for accumulating dust sucked in said suction unit;

a lid member rotatably engaged with one end of said dust collecting case to serve as the bottom of said dust collecting case;

a lock mechanism for sealably locking said lid member onto the bottom of said dust collecting case;

a lid opening mechanism for forcibly opening said lid member in cooperation with said lock mechanism locking said lid member.

In this arrangement, the lid opening mechanism is capable of forcibly opening the lid in collaboration with the lock mechanism in the event that the lid does not open by itself when the dust is compacted on the inner wall of the dust collecting case. Hence, the user can avoid a troublesome and unsanitary job of opening the lid by hand. The lid can be opened without difficulty in a simple procedure.

In the inventive electric vacuum cleaner, the lock mechanism may be a clamp lever formed with a hook that can be hooked on the periphery of the lid member, and the opening mechanism can be a lid opening stick for disengaging the hook of the clamp lever from the lid member and pressing the periphery of the lid member downward.

With this relatively simple arrangement, aforementioned merits of the invention can attained.

Alternatively, while the lock mechanism may be a clamp lever formed with a hook that can be hooked on the periphery of the lid member, the lid opening mechanism may be a lid opening lever urged to push the dust collecting case. This arrangement also provides the same merits of the invention as described above.

The lid opening lever is preferably configured to push ribs formed on both sides of the clamp lever to support the fulcrum of the clamp lever.

In this way, the ribs can be effectively utilized not only as means for supporting the fulcrum of the clamp lever but also as the means for facilitating disengagement of the lid member. As a result, no new element is necessary on the dust collecting case. No new manipulation of the dust collecting unit is required. The improvement requires no significant manufacturing cost.

The lid opening lever may be provided with a protrusion located between the two ribs.

The protrusion facilitates correct positioning of the lid member on the dust collecting case following the discharge of dust.

DETAILED DESCRIPTION OF THE PREFERRED EMBODIMENT

Figure 1:
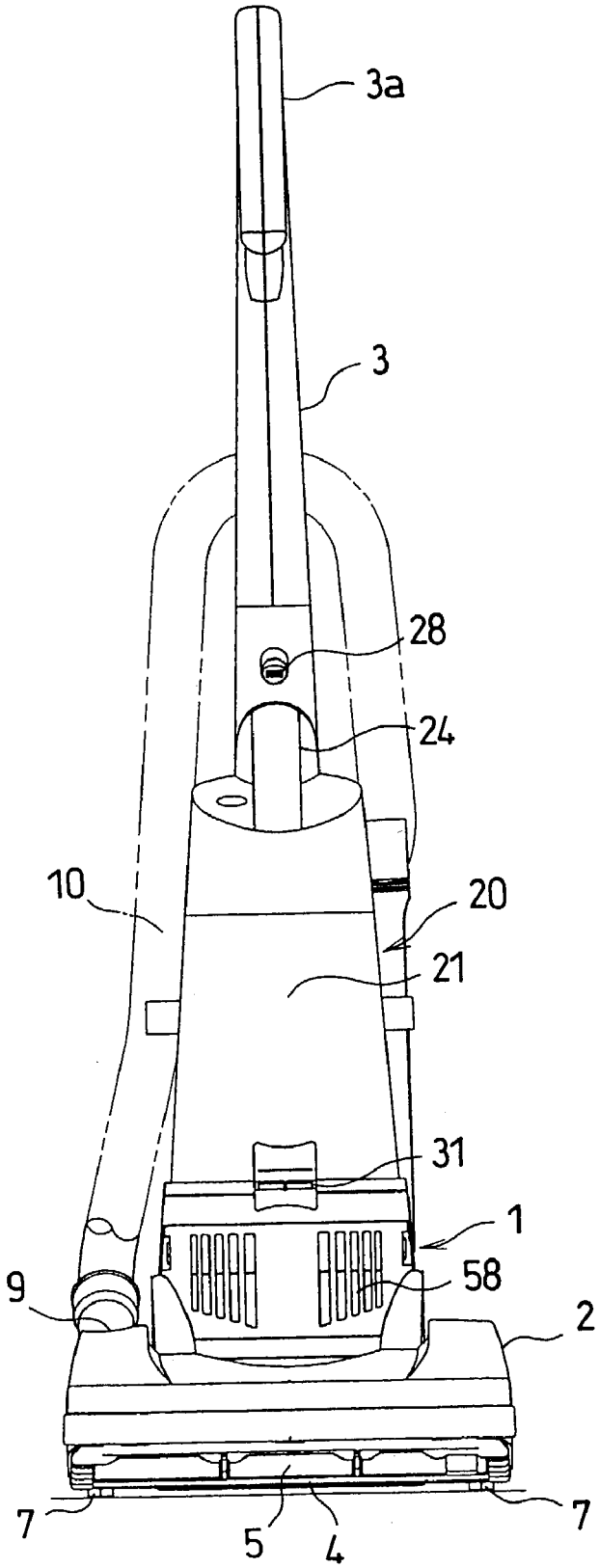
FIG. 1 is a front view of an upright electric vacuum cleaner according to the invention, which is equipped with a detachable dust collection unit mounted in the suction passage en route from a suction unit to an electric fan.
Figure 2:
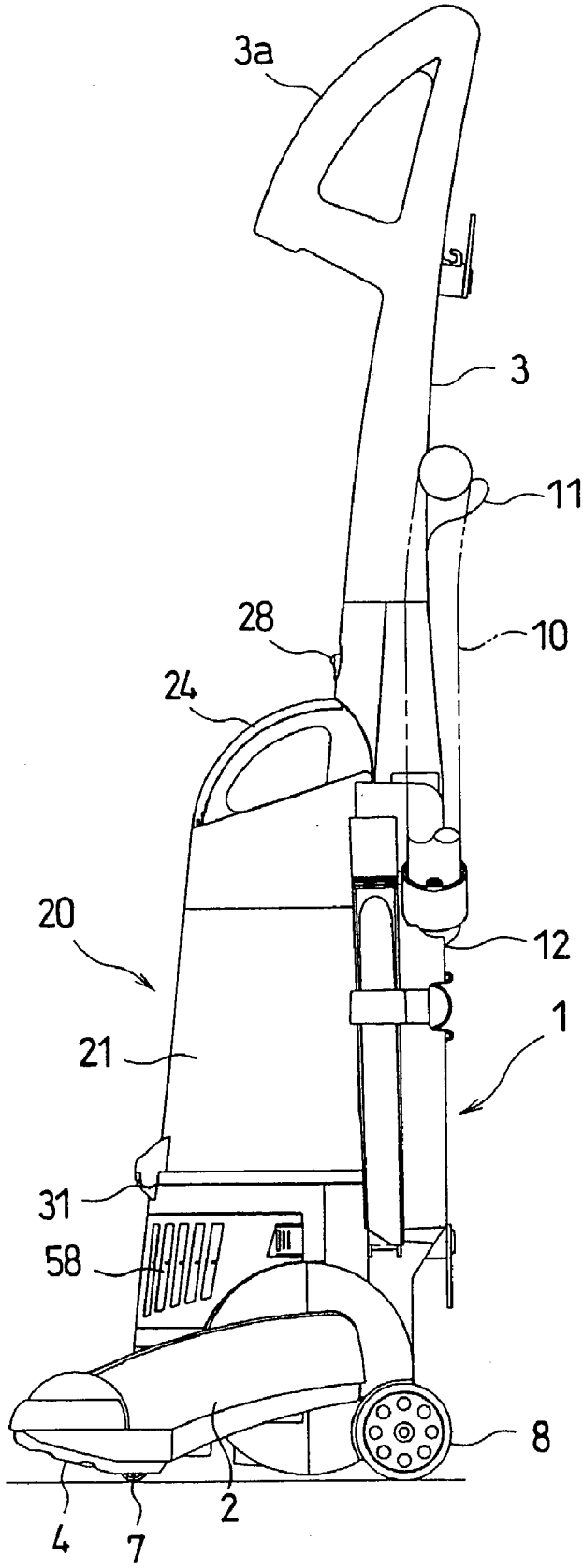
FIG. 2 is a side view of the upright electric vacuum cleaner shown in FIG. 1.

Referring to FIGS. 1–9, a first preferred embodiment of the invention will now be described in detail below. The first embodiment of the invention is an upright electric vacuum cleaner as shown in FIGS. 1 and 2. In this embodiment, the cleaner has a main body 1, a suction unit 2 provided beneath the main body 1 for sweeping a floor, and a manipulation handle 3 provided on top of the main body 1 for maneuvering the main body. The manipulation handle 3 extends upward from the back of the main body 1, and is provided at the top end thereof with a generally triangular grip section 3*a*, which protrudes forward.

The suction unit 2 has a suction port 4 facing the floor, and a rotary brush 5 facing the suction port 4. The rotary brush 5 is installed in the lower section of the main body 1, and operably connected to the shaft of a built-in electric fan (not shown) by means of a belt for example. Mounted on the opposite sides of the front end of the suction unit 2 are a pair of right and left front wheels 7, and on the rear of the lower end of the main body 1 are a pair of right and left rear wheels 8.

Formed on one side of the back of the suction unit 2 is a hose connector 9 that communicates at the lower end thereof with the suction port 4. One end of a hose 10 is detachably connected to the hose connector 9. The hose 10 extends over the back of the main body 1, via a holder section 11 provided on the back of the manipulation handle 3, to a suction cylinder 12 provided on one side of the back of the main body 1.

On the other hand, a dust collection unit 20 of the invention is detachably mounted on the central front section of the main body 1.

Figure 3:
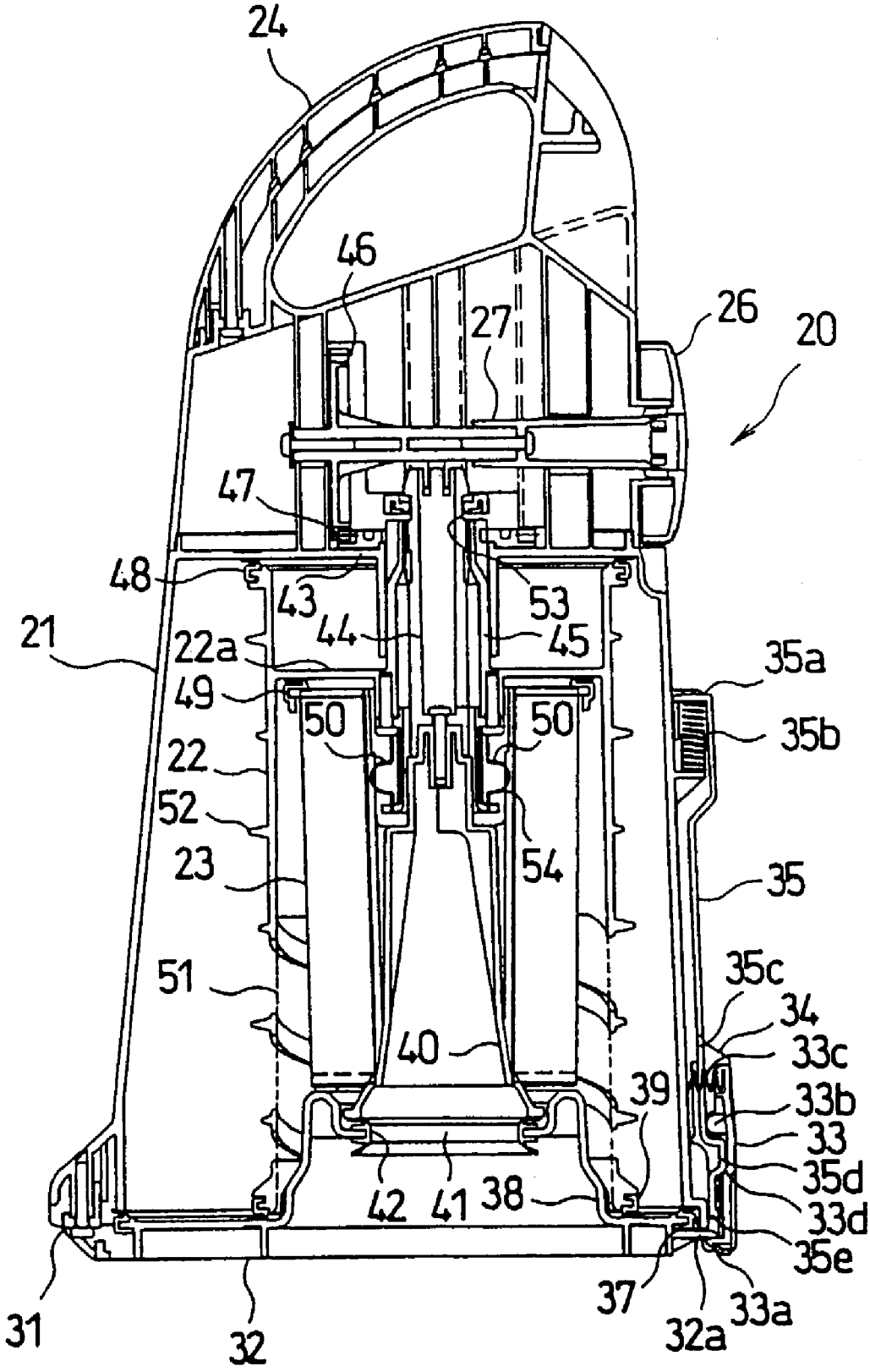
FIG. 3 shows a sectional side elevation of a dust collection unit for use with the upright electric vacuum cleaner of the invention.
Figure 4:
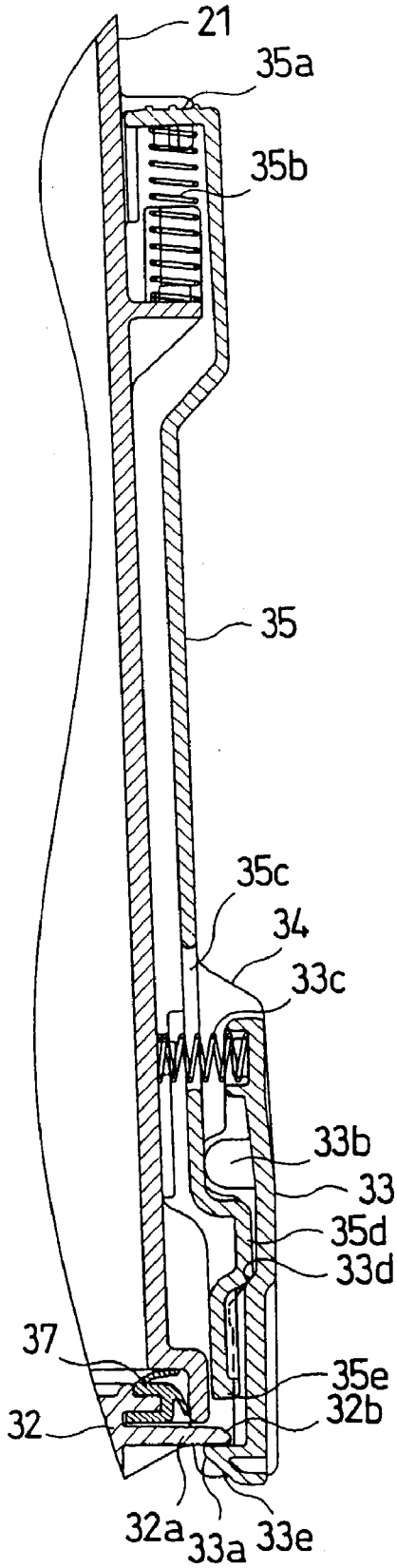
FIG. 4 is an enlarged sectional view of a main part of the lock mechanism and unlocking mechanism for use with the lid member of the dust collection unit shown in FIG. 3.
Figure 5:
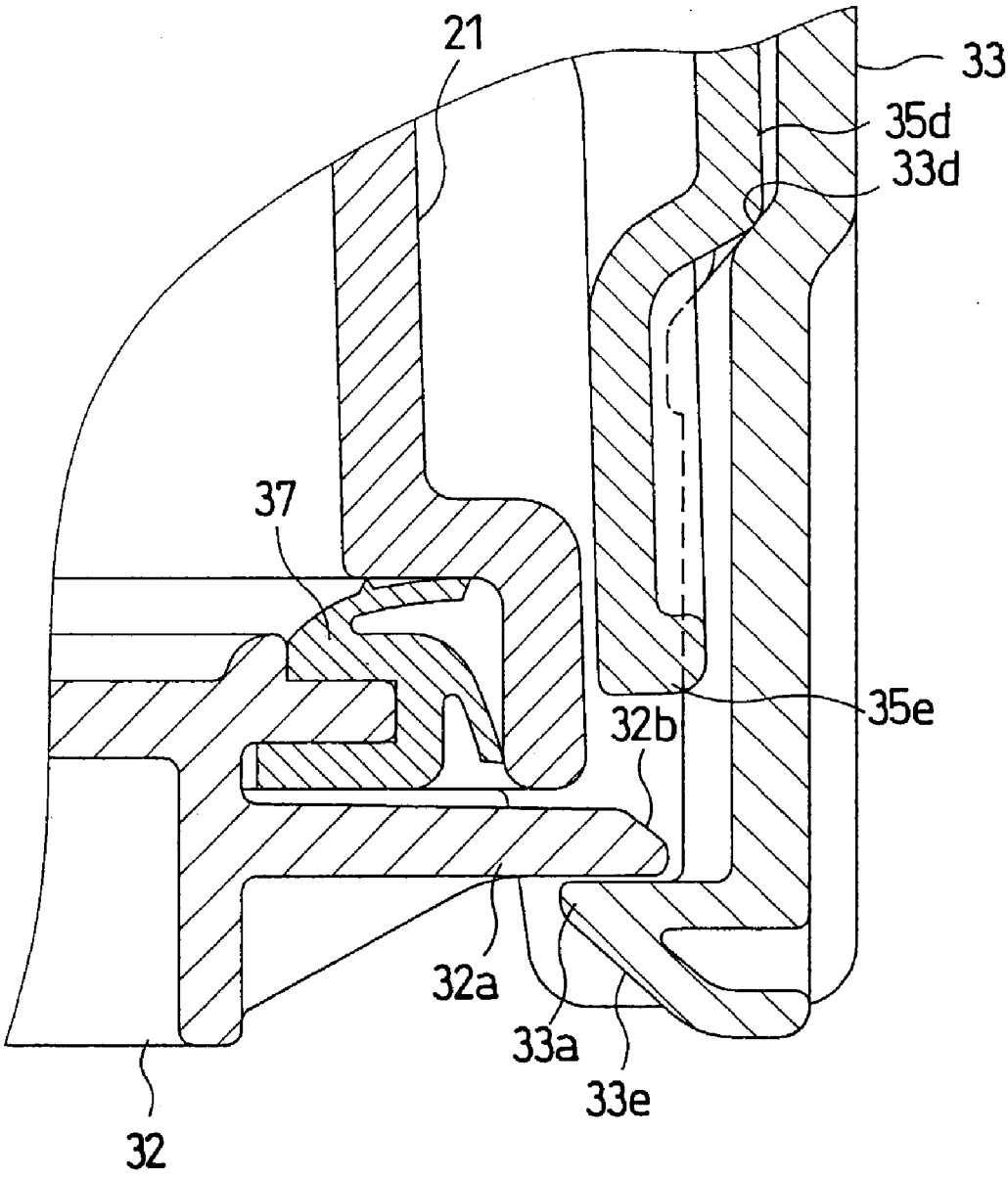
FIG. 5 is an enlarged sectional view of a main part of the lock mechanism and unlock mechanism shown in FIG. 4.

The dust collection unit 20 includes a cylindrical pre-filter 22 installed inside a cylindrical dust collecting case 21 made of a transparent resin, and a generally cylindrical main filter 23 inside the pre-filter 22 as shown in FIG. 3.

The dust collecting case 21 has an upper end which is inclined forward when the dust collecting case 21 is installed on the main body 1. Formed on the inclined upper end of the dust collecting case 21, and below the manipulation handle 3, is an arcuate hand grip 24 as shown in FIGS. 1 and 2.

On the back of the dust collection unit 20 is a rotary handle 26 for rotating the pre-filter 22. In the example shown herein, the rotary handle 26 has a form of a cap and is hidden and cannot be seen or touched from outside when the unit 20 is mounted on the main body 1 so that the handle 26 cannot be unintentionally operated by children.

The dust collecting case 21 is provided with a suction port (not shown), which, when mounted on the main body 1, communicates to an opening of a suction cylinder 12 via a packing or a seal. The suction cylinder is mounted on the back of the main body 1, offset to one side of the back. (This suction port is shown in the second embodiment by a reference numeral 30.) Because the suction port of the dust collecting case 21 is offset from the center of the dust collecting case 21, dust-containing air sucked from the suction port is set in a whirlpool motion inside the dust collecting case 21.

Rotatably (or pivotally) mounted on the bottom of the dust collecting case 21 is a lid member 32 via a hinge 31 (or fulcrum 31 for opening and closing the lid member). A clamp lever 33 is formed on the lower section of the dust collecting case 21. The closed lid member 32 can be locked by hooking up the clamp hook 33*a* formed on the lower end of the clamp lever 33 on an extended peripheral portion 32*a* of the lid member 32.

The clamp lever 33 has a fulcrum 33*b* which is rotatably mounted on two ribs 34 formed on the opposite sides of the clamp lever 33. Mounted at the upper end of the fulcrum 33*b* is a coil spring 33*c* for urging a hook 33*a* at the lower end of the fulcrum 33*b* towards the lid member 32.

In the embodiment shown herein, a lid opening stick 35 is slidably mounted between the clamp lever 33 and the dust collecting case 21 so that it can be freely moved in the vertical direction. A coil spring 35*b* is mounted at an upper manipulatory section 35*a* of the lid opening stick 35 to urge the lid opening stick 35 upward. The lid opening stick 35 is provided with a vertically elongated hole 35*c* formed at a position of the coil spring 33*c* such that the lid opening stick 35 will not abut on the coil spring 33*c* while moving up and down.

Formed below the fulcrum 33*b* of the clamp lever 33 is an outward protrusion 35*d* in correspondence with an inwardly inclined facet 33*d* formed on the clamp lever 33, so that when the lid opening stick 35 is pushed downward, outward protrusion 35*d* abuts on the inwardly inclined facet 33*d* of the clamp lever 33 to push the inclined facet 33*d* downward, thereby disengaging a clamp hook 33*a* from the extended portion 32*a* of the lid member.

Figure 8:
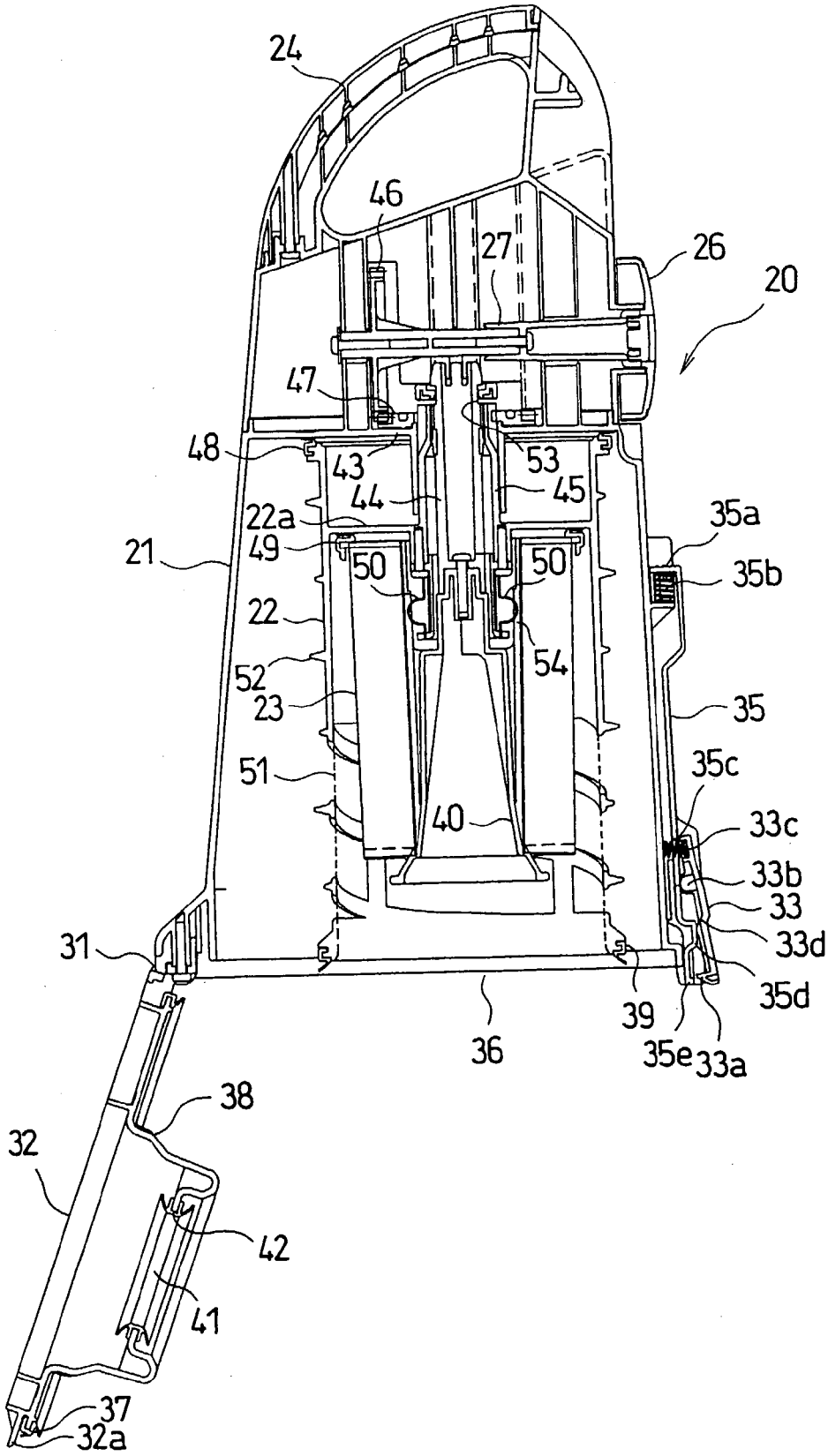
FIG. 8 shows a sectional side elevation of the dust collection unit of FIG. 3 with the lid member of the dust collection unit opened.
Figure 9:
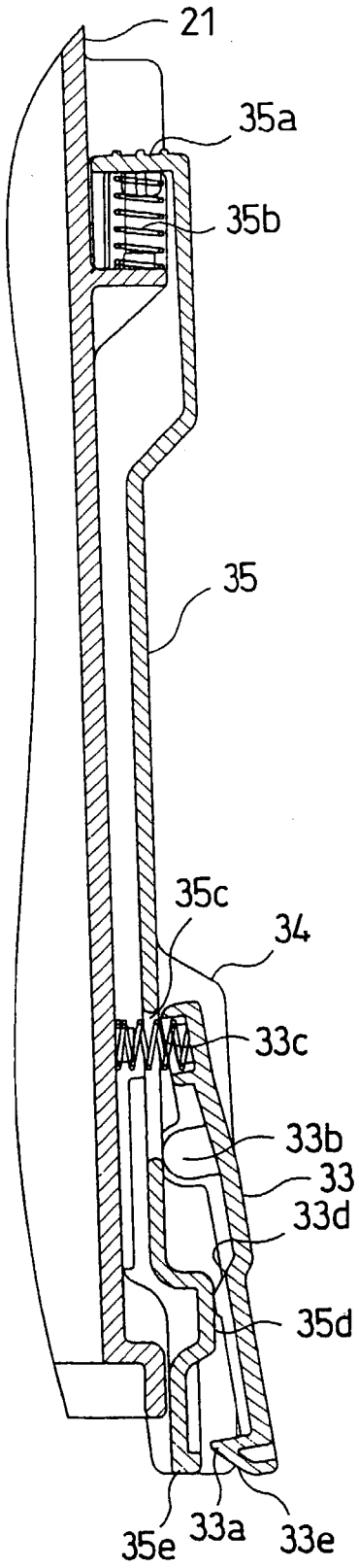
FIG. 9 shows an enlarged sectional side elevation of a main part of the lid member shown in FIG. 8.
Figure 10:
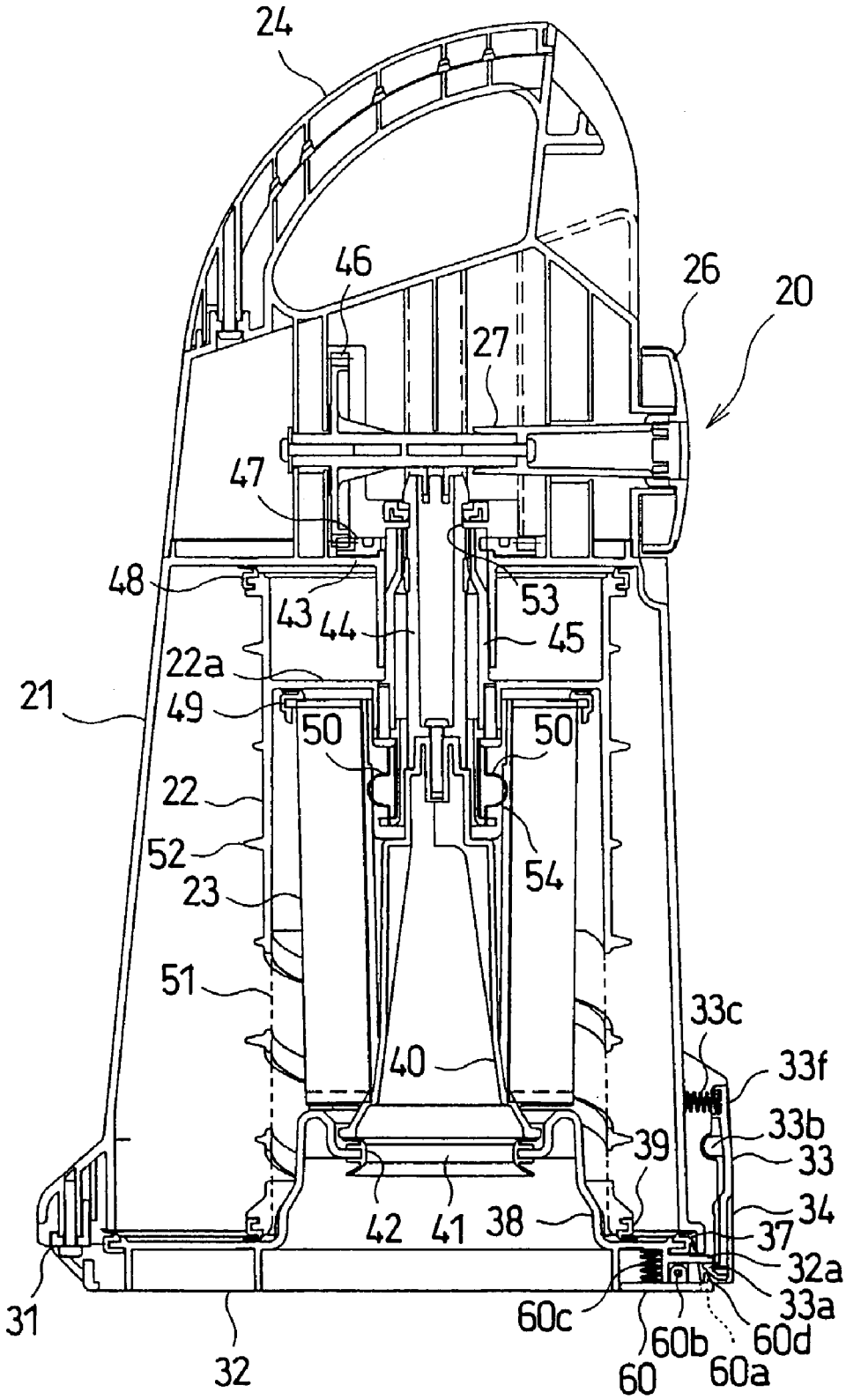
FIG. 10 shows a sectional side elevation of another dust collection unit for use with the upright electric vacuum cleaner of the invention.
Figure 11:
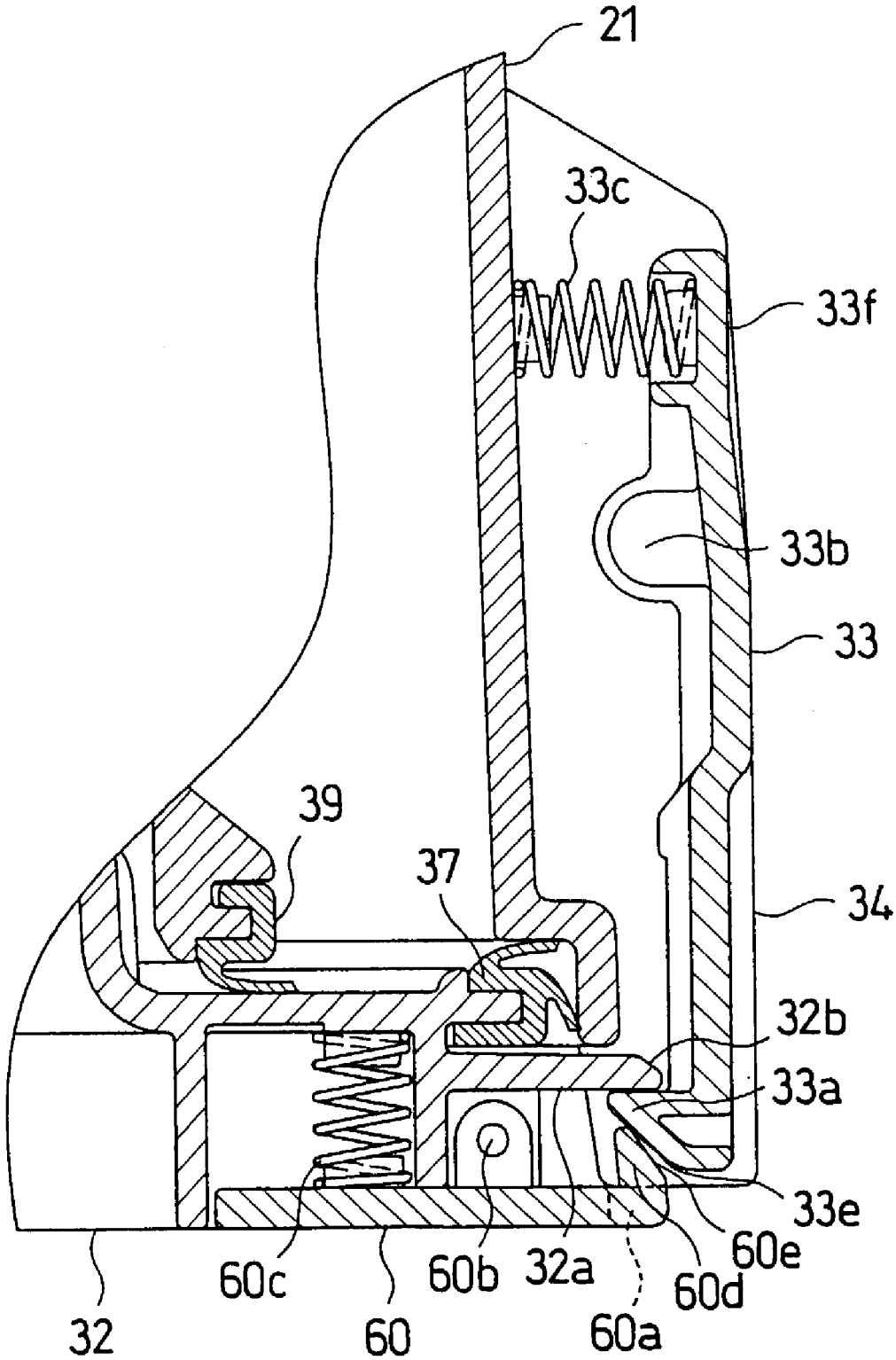
FIG. 11 is an enlarged sectional view of the dust collection unit of FIG. 10, showing in detail a main part of the lock mechanism and unlock mechanism.

The leading end 35*e* of the lid opening stick 35, when pushed down, abuts on the extended portion 32*a* of the lid member 32, thereby pushing it down, and forcibly opens the lid member 32 to thereby liberate it from the clamp hook 33*a*. This causes the dust outlet 36 of the dust collecting case 21 to be opened as shown in FIG. 8. The extended portion 32*a* of the lid member 32 has an upper inclined facet 32*b* in correspondence with the inclined facet 33*e* of the clamp hook 33*a* so that the lid member 32 can be closed without manipulating the clamp lever 33. When the outward protrusion 35*d* is pushed down, it is inwardly pushed by the clamp lever 33, the leading end 35*e* of the lid opening stick 35 pushes down the extended portion 32*a* without sliding on the inclined facet 32*b* of the extended portion 32*a*.

Mounted on the periphery of the lid member 32 is a packing 37 to seal the opening of the dust collecting case 21. Formed on the upper face of the lid member 32 is a protruding section 38 that can fit in the inner periphery of the lower opening of the pre-filter 22 so as to prevent transverse vibrations of the pre-filter 22. A packing 39 is provided on the open end of the pre-filter 22 for keeping the open end of the pre-filter 22 in tight contact with the upper surface of the lid member 32.

A suction port 41 is formed inside the top end of the protruding section 38 of the lid member 32. The suction port 41 is connected to the lower end of a cylindrical member 40, which forms an air passage for directing air from the main filter 23 to the exterior of the dust collecting case 21. A packing 42 is mounted on the inner periphery of the suction port 41 to keep the open end of suction port 41 and the cylindrical member 40 of the main filter 23 in sealing contact.

The main filter 23 is mounted on the top plate 43 of the dust collecting case 21 by means of a mounting shaft 44 that protrudes from the center of the main filter 23. A cylindrical hollow shaft 45 of the pre-filter 22 is mounted on the mounting shaft 44, extending between the top plate 43 of the dust collecting case 21 and the main filter 23.

Mounted on the upper end of the cylindrical hollow shaft 45 of the pre-filter 22 is an annular gear 47 that engages with an disk-shaped gear 46 mounted on the rotary shaft 27 of the rotary handle 26. Thus, rotation of the pre-filter 22 will cause the rotation of the rotary handle 26 in a predetermined direction. By forming a simple mechanism for rotating the pre-filter (the mechanism hereinafter referred to as pre-filter rotating mechanism) in this way, the pre-filter 22 can be firmly rotated. Mounted on the outer peripheries of the upper ends of the pre-filter 22 and the main filter 23 are packings 48 and 49, respectively, to keep the pre-filter 22 in tight contact with an upper partition plate 22*a* and the main filter 23 in tight contact with the top plate 43 of the dust collecting case 21, so as to prevent dust from entering the pre-filter rotating mechanism described above.

Resilient protrusions 50 are formed under the cylindrical hollow shaft 45 of the pre-filter 22. The resilient protrusions 50 abut on the plait tips formed on the inside of the main filter 23 as described later. With this arrangement, the resilient protrusions 50 are rotated together with the cylindrical hollow shaft 45 to prick the plait tips of the main filter 23, facilitating efficient removal of dust from the filter.

The lower section 51 of the pre-filter 22 is meshed for filtering larger pieces of dust. Because the meshed filter 51 is provided in the lower section of the dust collecting case 21, dust sucked in together with the air from a suction port (not shown) provided at an upper section of the dust collecting case 21 is forced to whirl downward at a high speed, and compacted on the bottom of the dust collecting case 21.

Formed on the external circumference of the pre-filter 22 are spiral ribs 52 that generally extend in the vertical direction. The ribs 52 are configured to push the dust accumulated and compacted in the dust collecting case 21 towards the dust outlet 36 of the lid member 32 when the rotary handle 26 is turned in the clockwise direction.

The main filter 23 is a plaited cylindrical paper filter surrounding the cylindrical member 40 serving as an air passage for the filtered air. The mounting shaft 44 fixed on the upper central section of the main filter 23 is fitted in a mounting bore 53 formed in the top plate 43 of the dust collecting case 21 in such a way that the mounting shaft 44 will not be rotated with the rotary pre-filter 22.

The tips of the plait inside the main filter 23 are covered with a plastic resin member 54 to prevent them from being worn by the friction with the rotating resilient protrusions 50 formed on the lower section of the cylindrical hollow shaft 45 of the pre-filter 22.

The clean air filtered by the dust collection unit 20 is discharged from the suction port 41 (of the dust collecting case 21) located below the cylindrical member 40 of the main filter 23. The air is then sucked into an electric fan (not shown), and exhausted, via an exhaust filter (not shown), from an outlet 58 formed in the lower front end of the main body 1.

In the upright vacuum cleaner of the invention as described above, dust on the floor is scratched by the rotary brush 5 of the suction unit 2 and enters the dust collecting case 21 through the hose 10 and the suction cylinder 12 positioned offset from the center of back of the main body 1. The dust is whirled downward along the inner wall of the dust collecting case 21. Larger pieces of dust accumulate on the bottom of the dust collecting case 21.

Since the mesh 51 of the pre-filter 22 is located in the lower section of the dust collecting case 21, dust sucked together with the air from the upper suction port is forcibly whirled downward, causing the dust to be accumulated and compacted on the bottom of the lid member 32 of the dust collecting case 21, as previously described. This compaction effect is significant especially when dust is cotton refuse. The compression rate is larger several fold, as compared with a conventional cyclone type separator. Because of such large compaction rate, the dust collection unit of the invention is capable of collecting a large amount of dust per unit volume.

On the other hand, fine dust enters inside the pre-filter 22 via the mesh 51 provided below the pre-filter 22, and is filtered by the plaited main filter 23. As a consequence, only clean filtered air is passed down to the electric fan and exhausted from the outlet 58.

As described above, in the dust collection unit 20 of the invention, the cylindrical pre-filter 22 is provided with resilient protrusions 50 formed at the lower end of the cylindrical hollow shaft 45 so as to prick the tips of the plait inside the main filter 23. In addition, spiral ribs 52 are provided on the exterior of the pre-filter 22. The cylindrical hollow shaft 45 of the pre-filter 22 is operably connected to the rotary handle 26 via the gears 46 and 47.

Consequently, when the rotary handle 26 is rotated in one (arbitrary) direction, the pre-filter 22 is rotated in a corresponding direction by means of the gears 46 and 47 and the cylindrical hollow shaft 45. As the pre-filter 22 is rotated, the resilient protrusions 50 located on the lower section of the shaft 45 prick the tips of the plait (resin member 54) inside the main filter 23, causing vibrations therein, which in turn causes fine dust accumulating on the surface of the main filter 23 to fall off. Large-sized pieces accumulating in a compacted form in the dust collecting case 21 sweep fine dust which is sticking to the outer surface of the pre-filter 22. Accordingly, lowering of dust collecting efficiency of the dust collection unit caused by accumulation of dust on the main filter 23 and pre-filter 22 may be effectively prevented.

As the large-sized dust pieces or trash accumulates in the dust collecting case 21, the mesh 51 formed below the pre-filter 22 can be gradually clogged. In the event that clogging has taken place, the dust collection unit 20 is once disengaged from the vacuum cleaner, and by rotating the rotary handle 26, and hence the pre-filter 22, to move the spiral ribs 52 formed thereon up and down, gaps (air passage) can be formed between the mesh 51 and the trash, that prevents lowering of dust collection efficiency of the filter.

On the other hand, to remove the dust accumulated in the dust collecting case 21, the hand grip 24 of the dust collecting case 21 is withdrawn by hand while pressing the button 28 provided on the hand grip 24. This permits the dust collecting case 21 to be disconnected from the main body 1.

Figure 6:
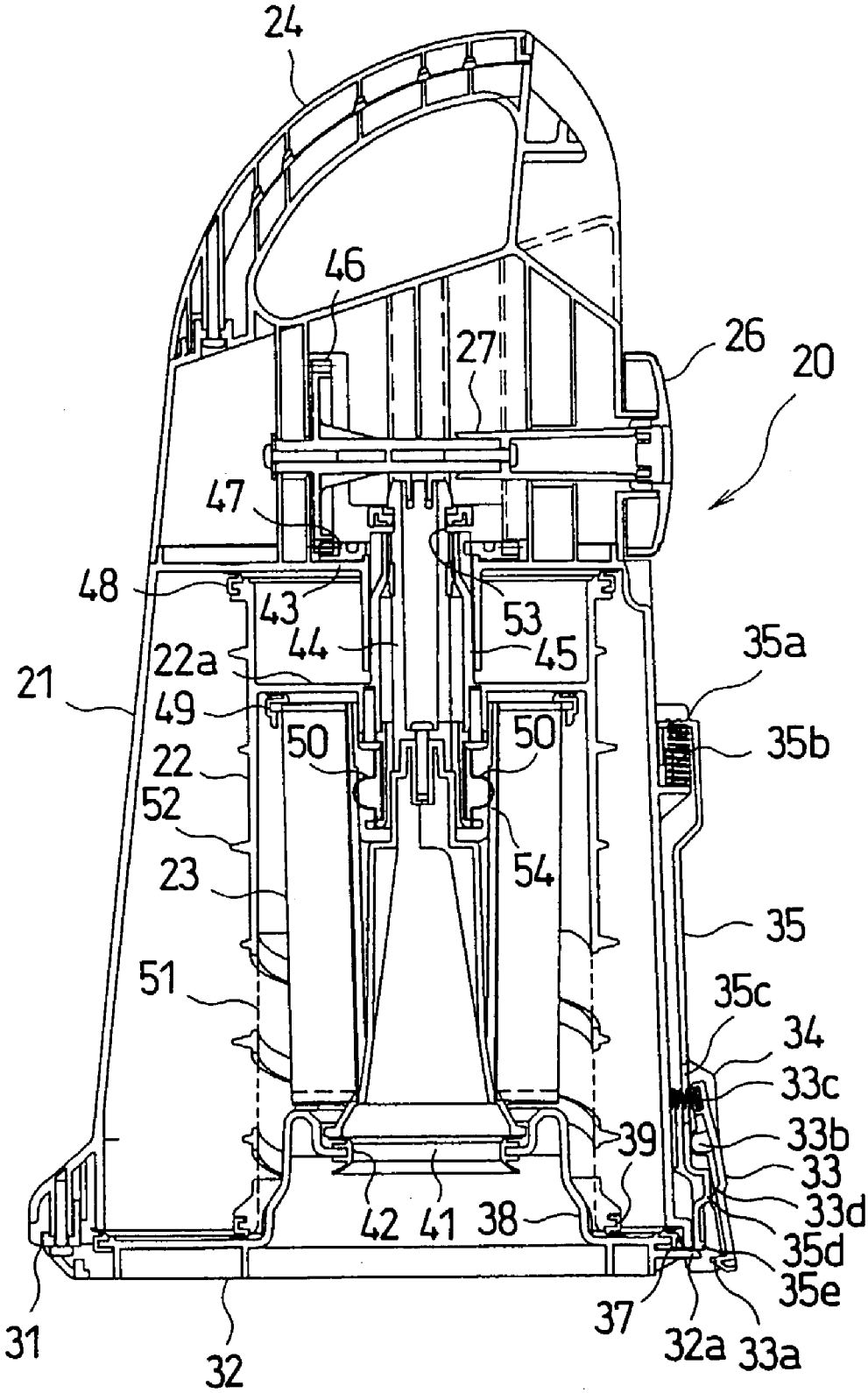
FIG. 6 shows a sectional side elevation of the clamp hook of the dust collecting case of the dust collection unit shown in FIG. 3, showing a condition that the clamp hook is unhooked.
Figure 7:
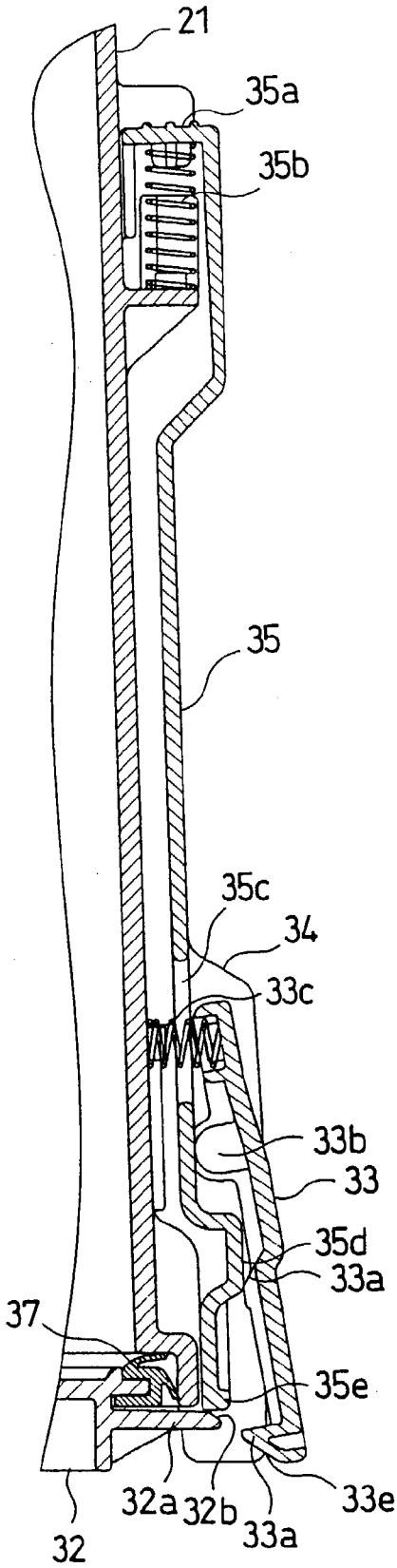
FIG. 7 shows an enlarged sectional view of a main part of the lock mechanism shown in FIG. 6.

If the manipulatory section 35*a* of the lid opening stick 35 is forced down as shown in FIGS. 6 and 7, the outward protrusion 35*d* formed on the lower end of the lid opening stick 35 abuts against the inwardly inclined facet 33*d* of the clamp lever 33, causing the inwardly inclined facet 33*d* to recede outward, thereby rotating the clamp lever 33 away from the extended portion 32*a* of the lid member 32 and disconnecting the clamp hook 33*a* of the clamp lever 33 from the extended portion 32*a*. If the manipulatory section 35*a* is further forced down, the leading end 35*e* of the stick 35 abuts on the extended portion 32*a* and pushes it down, causing the lid member 32 to be forcibly opened as shown in FIG. 8. Now, the dust accumulated in the dust collecting case 21 can be removed from the dust collecting case 21.

Thus, if the sealing pressure of the packing 37 is increased to enhance sealability of the lid member 32 or if the compacted dust in the dust collecting case 21 sticks to the inner wall of the dust collecting case 21, not weighing on the lid member 32, the lid member 32 can be easily and securely opened without manually opening it by hand, thereby permitting the user to avoid laborious and unsanitary operations of opening the lid member 32.

It is noted that although the lid member 32 can be easily opened, cotton refuse in particular does not come off the inner wall of the dust collecting case 21 when it is compacted on the wall. In this case, the spiral ribs 52 provided on the exterior of the pre-filter 22 may be operated to push the compacted dust such as cotton refuse outward. This facilitates easier removal of the sticking dust. This can be done by turning the rotary handle 26 to rotate the pre-filter 22 in a predetermined direction (right in the example shown).

Since the hinge 31 of the lid member 32 (or fulcrum for opening the lid member) is provided on the same side as the hand grip 24 of the dust collecting case 21, the lid member 32 can prevent removed dust from coming unexpectedly close to the user or splashing to the user when the hand grip 24 is held and the lid member 32 is opened (FIG. 8).

Every time dust is removed, dust cleaning function of the pre-filter is executed by the rotation of the pre-filter 22, so that lowering of dust collecting efficiency of the filter is prevented if the user is not cognizant of cleaning the filter.

As described above, a vacuum cleaner in accordance with the embodiment described above provides an economic advantage that, unlike conventional cleaners, it can be used semipermanently without any replacement of disposable paper bag. In addition, the usability of the dust collection unit is greatly improved to that of a disposable type unit or more than that.

The upright dust collection unit 20 may have a sufficient inner volume that it is especially suitable for a heavy duty upright vacuum cleaner.

An upright vacuum cleaner of the invention is provided with a generally triangular protruding grip 3*a* formed on top of the manipulation handle 3 that extends upward from the back of the main body 1, as shown in FIG. 3. Hence, the grip section 3*a* provides the user with convenience that he needs not to stoop over the cleaner while cleaning, for example, the floor under a bed if he inclines the cleaner through a large angle, since he can then keep the grip section 3*a* at a convenient height.

FIGS. 10–19 show further embodiments of the invention, in which the same reference numerals refer to the same components as before. The main body 1 is the same as the preceding one shown in FIGS. 2 and 3. The dust collecting case 21 is provided in the back thereof with a suction port 30 offset to one side of the back as shown in rear views of FIGS. 12, 16, and 18. The suction port 30 communicates to the suction cylinder 12 of the main body 1 when they are air-tightly connected together.

A unique feature of this embodiment is that the lid member 32 has a special opening mechanism. The rest of the features of the embodiment are the same as those of the preceding ones.

As compared with the preceding lid opening mechanism in which the lid opening stick 35 is formed on the dust collecting case 21, this lid opening lever 60 is provided on the lid member 32.

The lock mechanism has a clamp lever 33 attached to one side of the dust collecting case 21 opposite the hinge 31 of the lid member 32 (or fulcrum for opening the lid member), and having a hook 33*a* to be hooked on the extended portion 32*a* formed on the fringe (or outer periphery) of the lid member 32, like a preceding embodiment. However, the lid opening mechanism is provided with a lid opening lever 60 which is mounted on the underside of the lid member 32 correspondence with the clamp lever 33, opposite the hinge 31, and is urged to push the underside of the dust collecting case 21.

Figure 12:
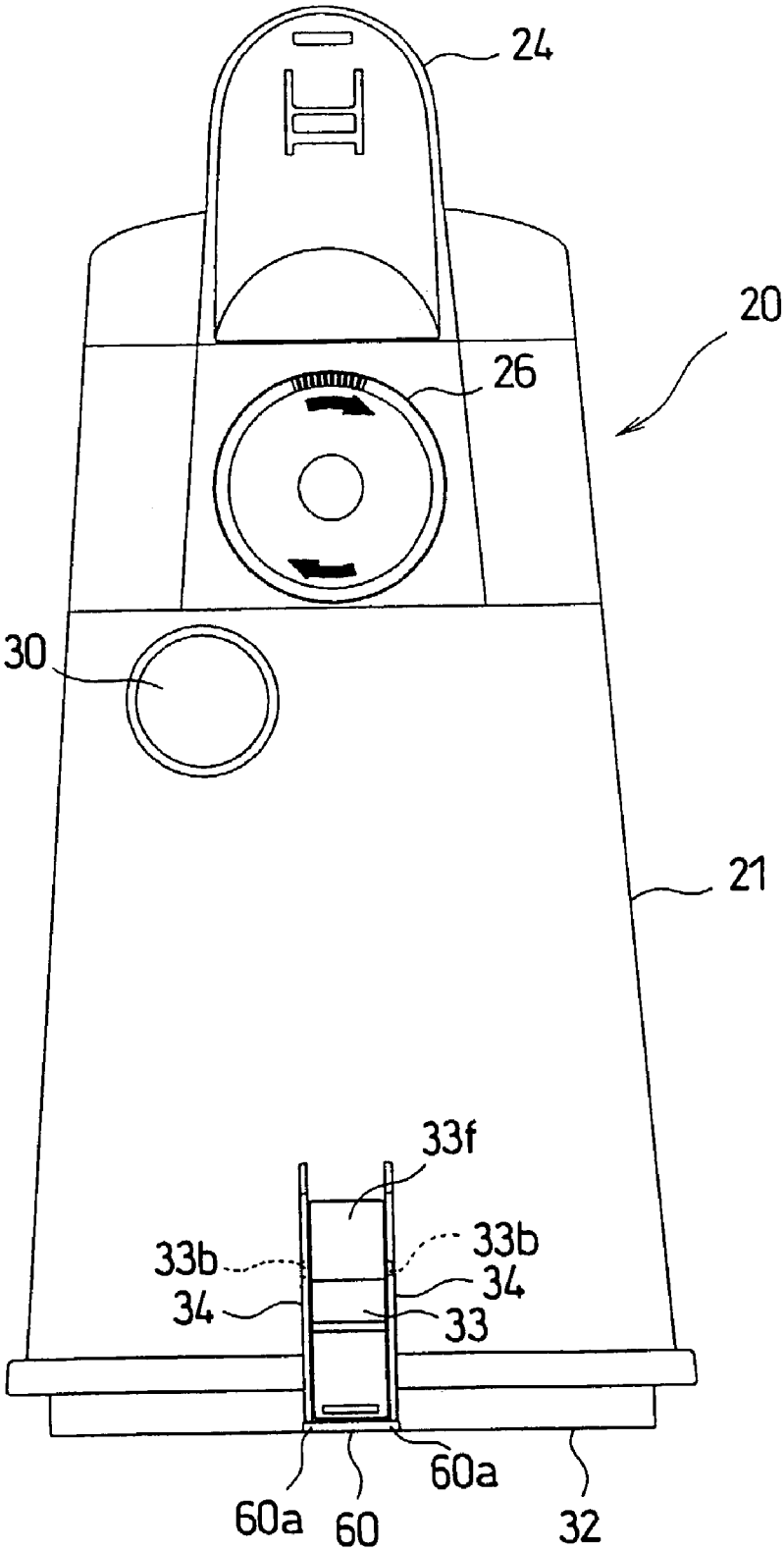
FIG. 12 is a rear view of the dust collection unit shown in FIG. 10.
Figure 13:
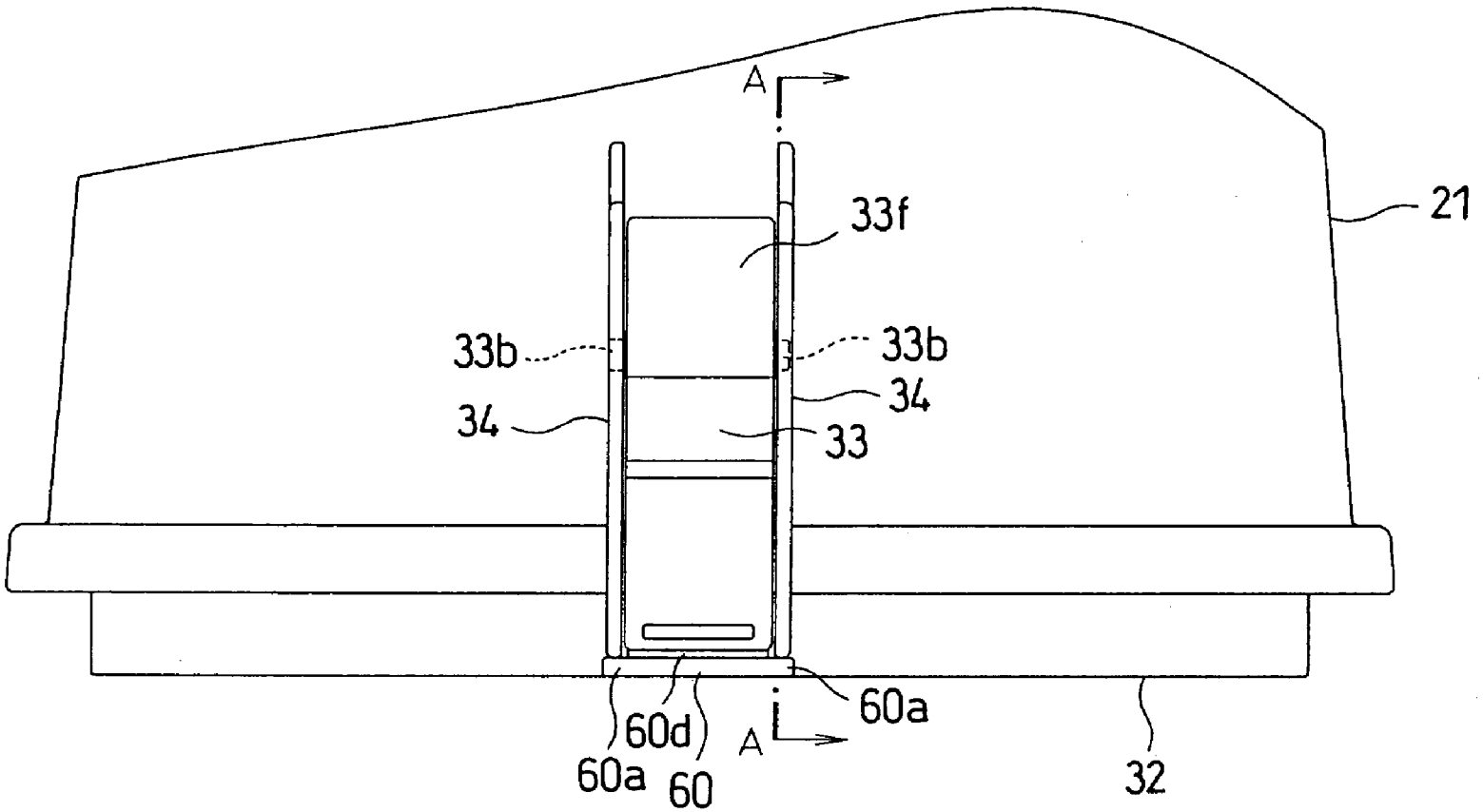
FIG. 13 is an enlarged rear view of a main part of the dust collection unit shown in FIG. 12.
Figure 14:
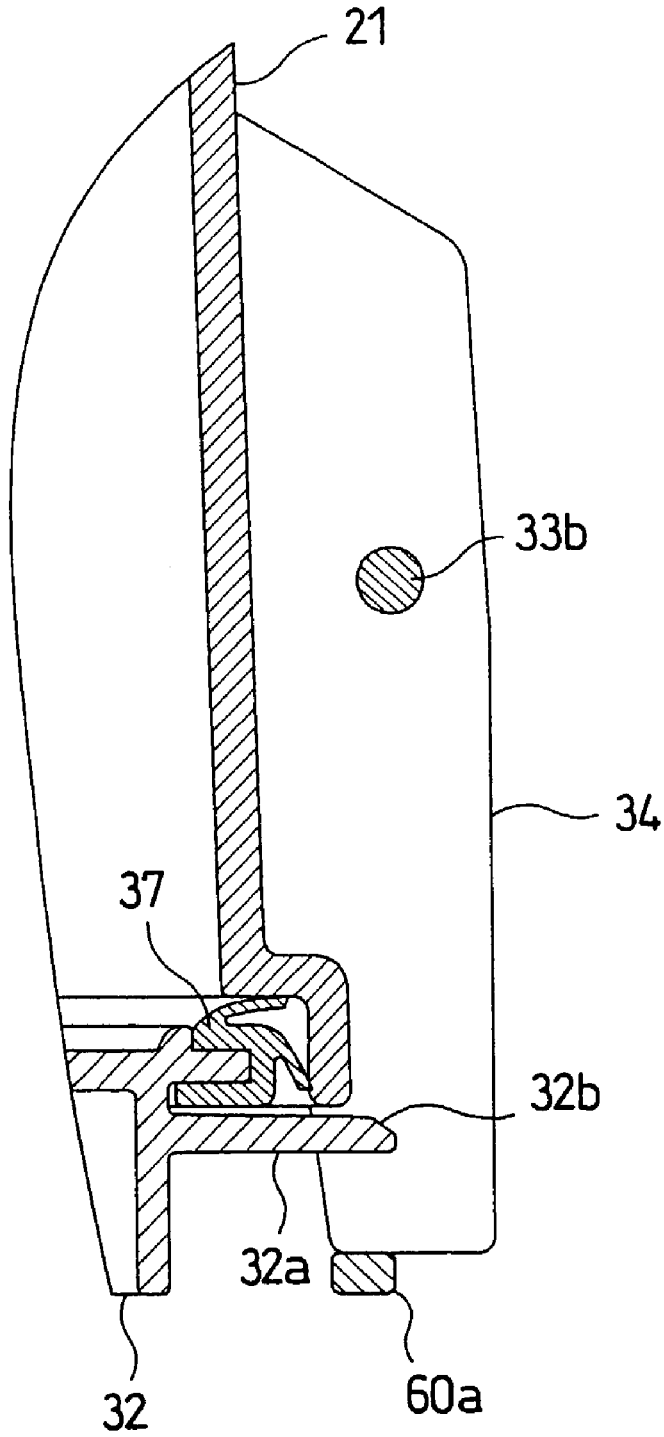
FIG. 14 shows a cross section taken along line A—A of FIG. 13.

The lid opening lever 60 is provided at one end thereof with pushing sections 60*a* that protrude from the opposite sides of said one end to push the lower ends of the ribs 34 supporting the fulcrum 33*b* of the clamp lever 33, as shown in FIGS. 12–14. The lid opening lever 60 is urged by a coil spring 60*c* mounted on the other end of the fulcrum 60*b* of the lever 60 so as to push the lower ends of the ribs 34 against the upper pushing sections 60*a*.

In addition, the lid opening lever 60 is provided at the tip thereof with a protrusion 60*d* located between the two ribs 34. The facet 60*e* of the protrusion 60*d* facing an inclined facet 33*e* of the clamp hook 33*a* is correspondingly inclined so as not to hinder locking operation of the clamp hook 33*a*, as shown enlarged in FIG. 11.

Figure 15:
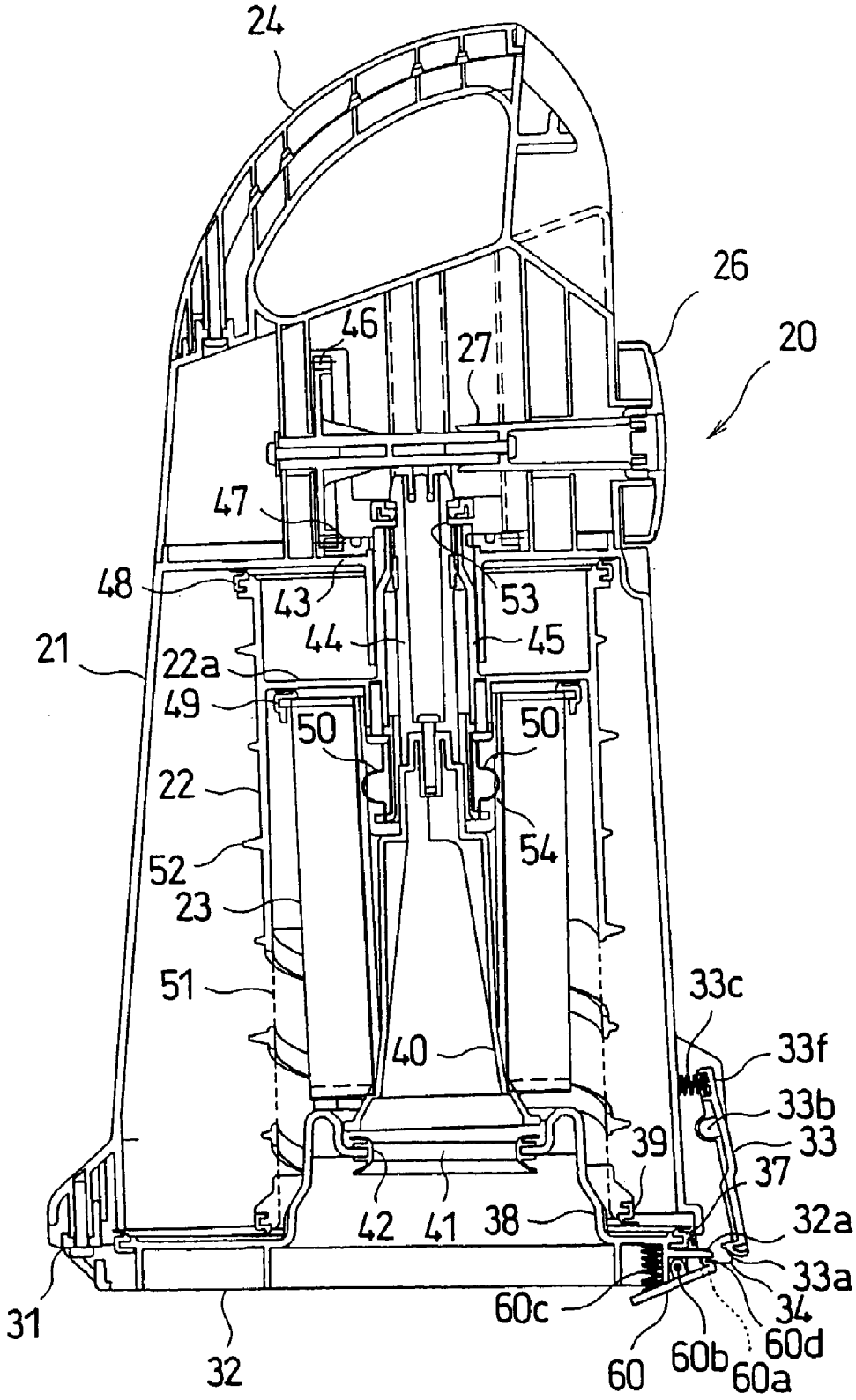
FIG. 15 shows a sectional side elevation of the dust collection unit of FIG. 10 when the clamp hook is disengaged and the lid opening lever starts opening the lid member.
Figure 16:
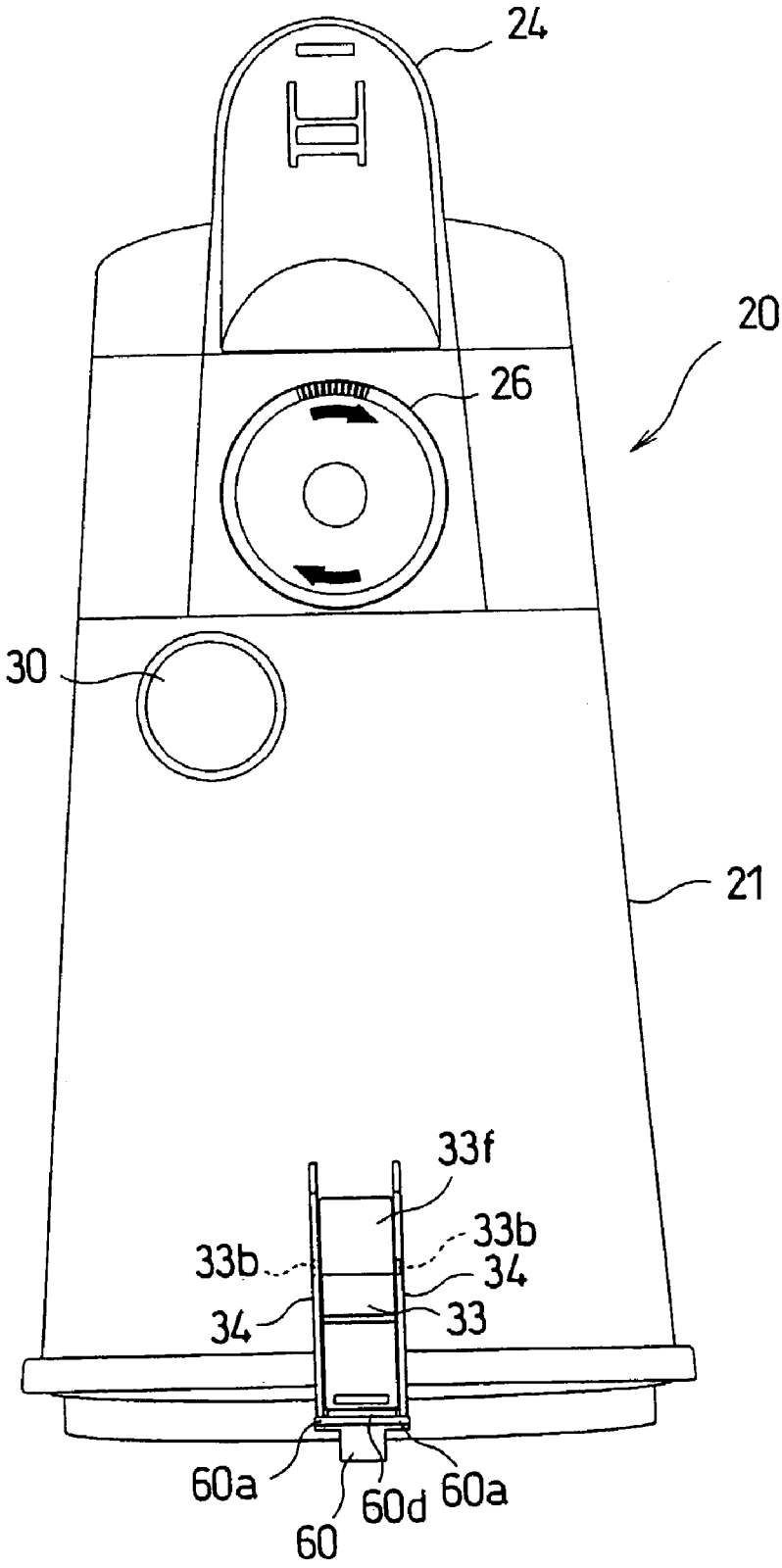
FIG. 16 is a rear view of the dust collection unit in the same condition as shown in FIG. 15.
Figure 17:
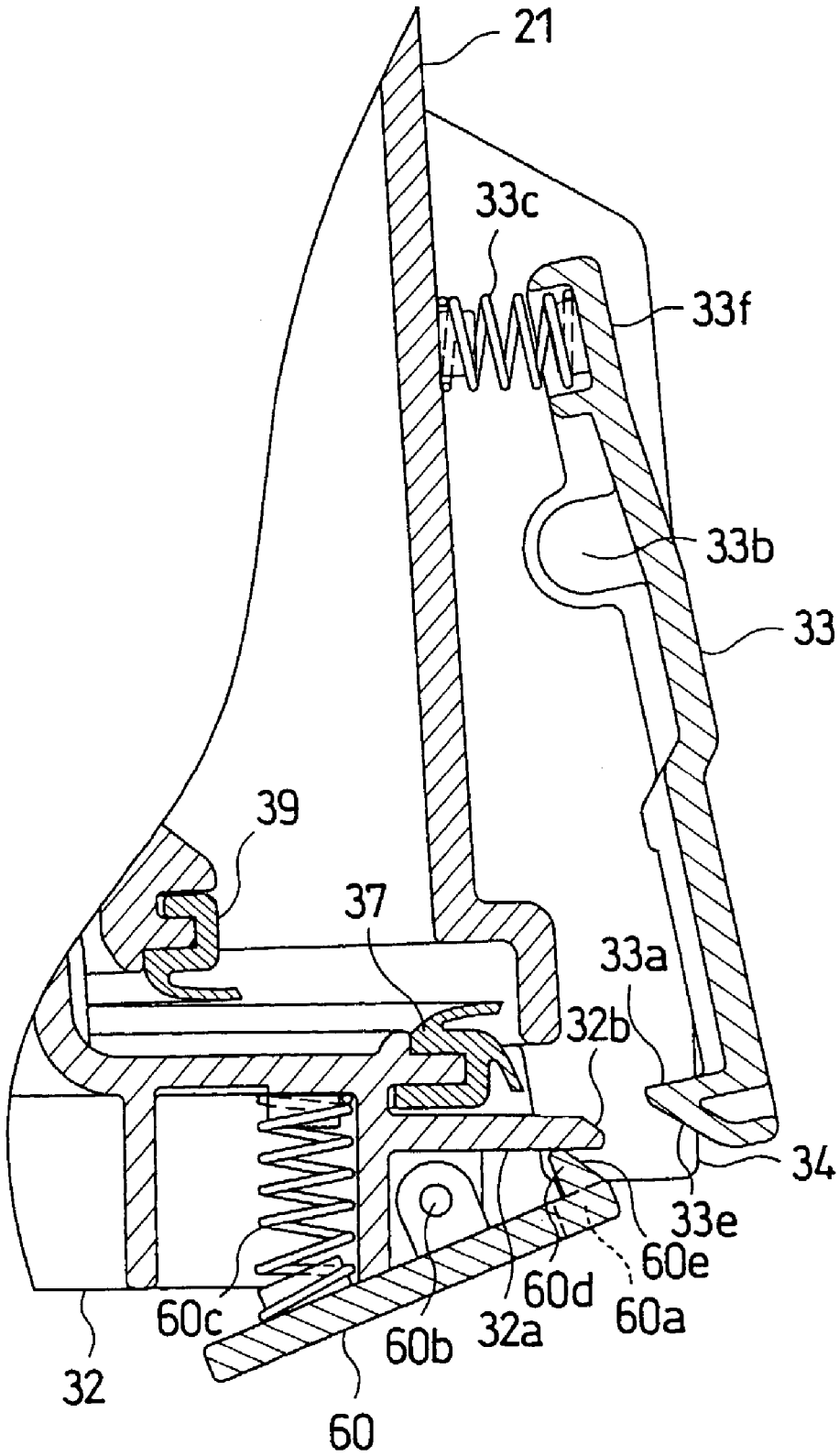
FIG. 17 is an enlarged sectional view of a main part of the dust collection unit shown in FIG. 15.

In the arrangement described above, in order to discharge the accumulated dust from the dust collecting case 21, the upper section 33*f* of the clamp lever 33 is pushed to disengage the clamp hook 33*a* at the lower end thereof from the extended portion 32*a* of the lid member 32 as shown in FIGS. 15–17.

Figure 18:
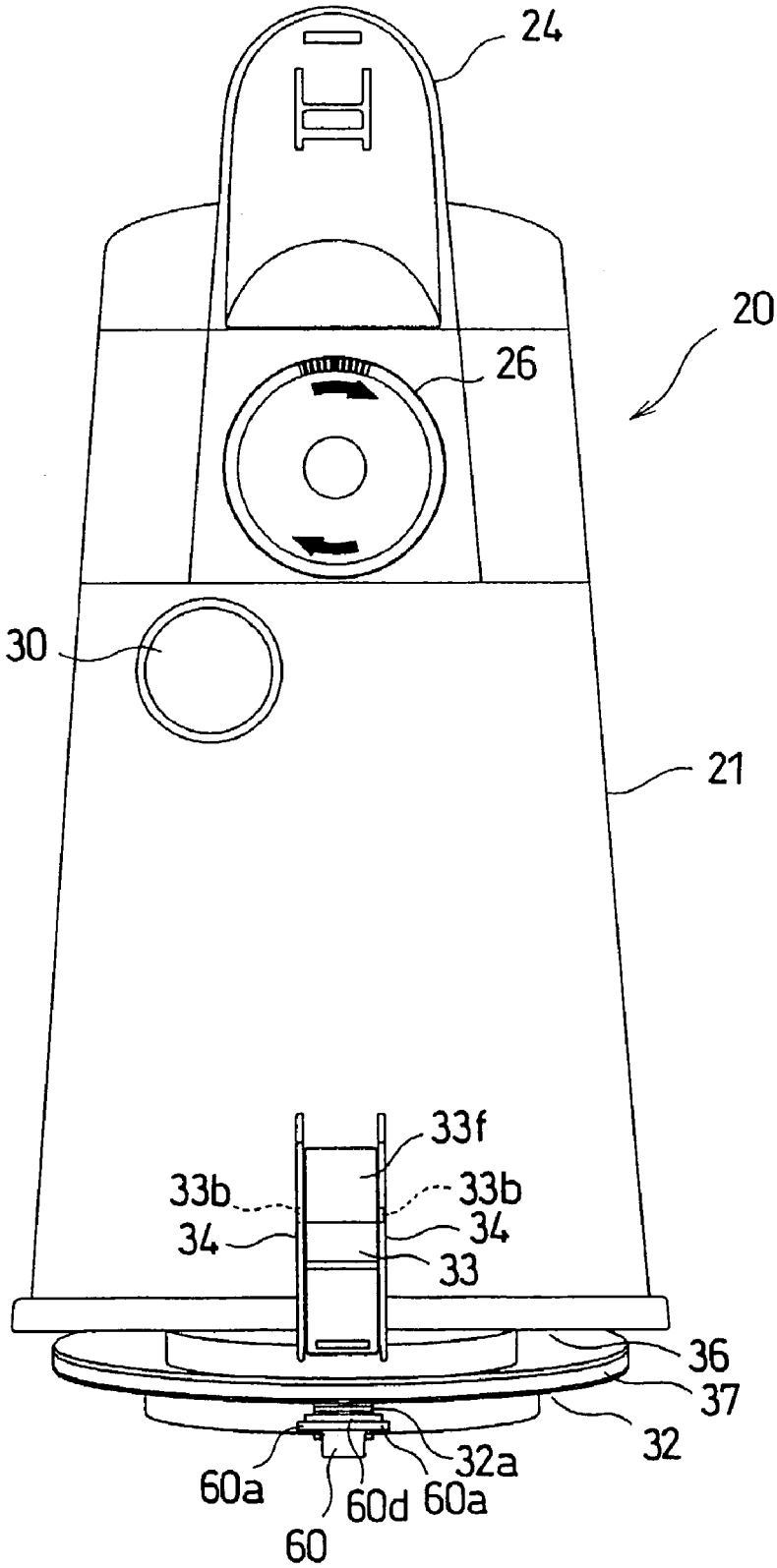
FIG. 18 shows a rear view of the dust collection unit of FIG. 15, with the lid member further opened.
Figure 19:
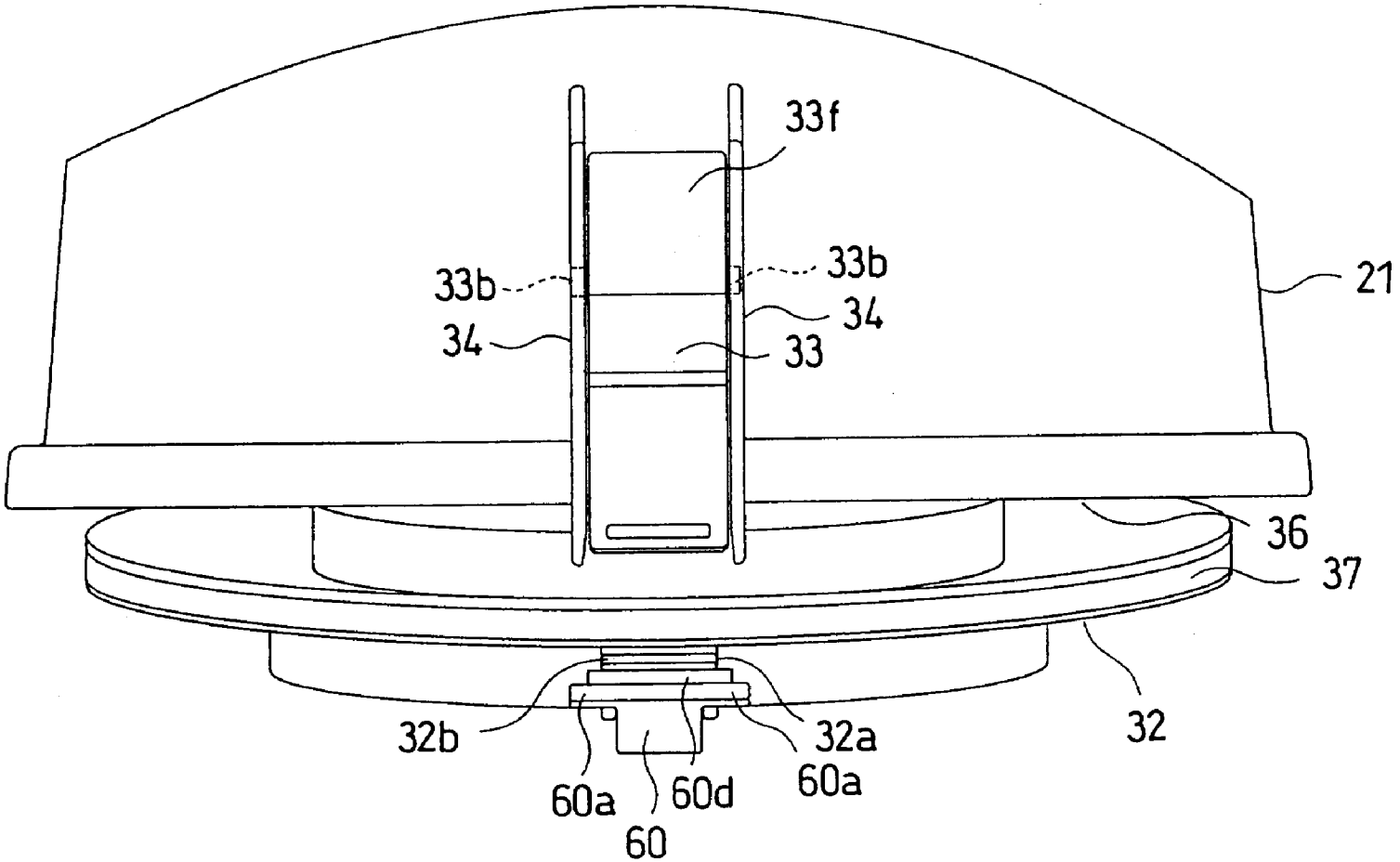
FIG. 19 shows an enlarged rear view of the dust collection unit shown in FIG. 18, showing in detail the main part of the dust collection unit.

When the lid member 32 is unlocked from the clamp hook 33*a*, a downward force acts on the lid member 32 as a consequence of the reaction of pushing the undersides of the ribs 34 of the dust collecting case 21 by the pushing section 60*a* of the lid opening lever 60. The downward force will cause the lid member 32 to be opened to the position as shown in FIGS. 15–17. As the lid member 32 is opened like this, the packing 37 is also disengaged from the open end of the dust collecting case 21, allowing the lid member 32 to open by the weight of its own as shown in FIGS. 18–19. The dust accumulated in the dust collecting case 21 is thus discharged from the case 21.

In this way, as in the preceding embodiments, manual operations of the lid member 32 are not necessary to open the lid member if the weight of the compacted dust does not facilitate the disengagement of the lid member due to the fact that the dust is compacted in the dust collecting case 21 and sticks to the inner wall of the case 21. Thus, the user can avoid unsanitary job of opening the lid member 32 to remove the dust by hand.

In this embodiment, the two ribs 34 supporting the shaft 33*b* of the clamp lever 33 are utilized advantageously to create a reaction force to disengage the lid member from the dust collecting case, and no additional element is required on the dust collecting case 21 for liberating the lid member. Thus, the dust collection unit can be manufactured at no extra cost. The unit can be operated like a conventional one.

The protrusion 60*d* formed between the two ribs 34 facilitates correct positioning of the lid member 32 following the removal of dust.

What is claimed is:

1. An electric vacuum cleaner equipped with a dust collection unit detachably installed in the air suction passage en route from a suction unit to an electric fan, said dust collection unit comprising:

a dust collecting case for accumulating dust sucked in said suction unit:

a lid member pivotally engaged with one end of said dust collecting case to serve as the bottom of said dust collecting case;

a lock mechanism for sealably locking said lid member onto the bottom of said dust collecting case;

a lid opening mechanism for pushing said lid member into an open position with respect to said dust collecting case in cooperation with said lock mechanism locking said lid member.

2. The electric vacuum cleaner according to claim 1, wherein said lock mechanism has a clamp lever formed with a hook to be hooked on an outer periphery of the said lid member; and said lid opening mechanism has a stick for pushing said lid member into an open position by disengaging said hook of said clamp lever and pushing said outer periphery of the said lid member.

3. The electric vacuum cleaner according to claim 1, wherein said lock mechanism has a clamp lever formed with a hook to be hooked on an outer periphery of said lid member; and said lid opening mechanism has a lid opening lever urged to push said dust collecting case.

4. The electric vacuum cleaner according to claim 3, wherein said lid opening lever is arranged to push the ends of the ribs formed on the opposite sides of said clamp lever to support a fulcrum of said clamp lever.

5. The electric vacuum cleaner according to claim 4, wherein said lid opening lever has a protrusion formed between said ribs.

* * * * *